US005863629A

United States Patent [19]

Kuo et al.

[11] Patent Number: 5,863,629

[45] Date of Patent: Jan. 26, 1999

[54] WRITING SYSTEM OF STACKED CARBONLESS REPOSITIONABLE SELF-ADHESIVE PAPER

[75] Inventors: Tsung-Tien Kuo, Kaohsiung Hsien; Hsieh-Chang Hsieh, Feng Shan Kaohsiung; Hsien-Min Kuo, Kaohsiung, all of Taiwan

[73] Assignee: Taiwan Hopax Chemicals Mfg., Co., Ltd., Kaohsiung, Taiwan

[21] Appl. No.: 723,044

[22] Filed: Sep. 30, 1996

[51] Int. Cl.[6] ..... B41M 5/165

[52] U.S. Cl. ..... 428/40.1; 428/40.2; 428/42.2; 428/42.3; 428/220; 462/72; 503/214

[58] Field of Search ..... 428/40.1, 40.2, 428/42.2, 42.3, 220; 503/214; 462/72

[56] References Cited

U.S. PATENT DOCUMENTS

| | | | |
|---|---|---|---|
| 4,714,276 | 12/1987 | Greig | 283/63 R |
| 4,720,479 | 1/1988 | Craig et al. | 503/200 |
| 4,798,401 | 1/1989 | Greig | 282/9 R |
| 4,822,770 | 4/1989 | Sud | 503/214 |
| 4,833,122 | 5/1989 | Doll | 428/40.2 |
| 5,352,648 | 10/1994 | Chao | 503/206 |

FOREIGN PATENT DOCUMENTS

| | | |
|---|---|---|
| 0281344A2 | 2/1988 | European Pat. Off. . |
| 0325057A2 | 12/1988 | European Pat. Off. . |
| 0486127A1 | 5/1991 | European Pat. Off. . |

*Primary Examiner*—Nasser Ahmad
*Attorney, Agent, or Firm*—Hamilton, Brook, Smith & Reynolds, P.C.

[57] ABSTRACT

The copying system comprises a plurality of units in a stacked configuration, where each unit comprises two or several sheets of carbonless, repositionable self-adhesive paper. Image transfer upon writing pressure results in copies of the message made in a single unit but not on subsequent units in the stack. Image transfer is controlled by regulating the microcapsule size of the carbonless copying component on the first sheet in each unit and the basis weight of the last sheet of paper in each unit.

15 Claims, 5 Drawing Sheets

WRITING SYSTEM OF STACKED CARBONLESS REPOSITIONABLE SELF-ADHESIVE PAPER

BACKGROUND OF THE INVENTION

Efforts have been made to provide office supplies which can reduce the input time for a particular writing/copying task. Carbonless copying paper was developed to achieve this objective and has been used in business forms and multi-sheet note pads, for example. Since its introduction, carbonless copying paper has been modified to develop additional products for multi-copying tasks.

U.S. Pat. No. 5,352,648, issued to Chao, describes a pressure sensitive copying paper with repositionable adhesive properties. The copying system includes a plurality of stacked sheets of paper which are temporarily attached to each other with a pressure sensitive adhesive. The pressure sensitive adhesive is applied onto the paper's surface as a mixture of adhesive and carbonless microcapsules. The problem with this configuration is that the manufacturer must make the carbonless paper rather than use pre-made carbonless paper from another manufacturer. This translates into additional materials and manufacturing costs and downstream product costs for the consumer.

Combining the concepts of repositionable adhesives and carbonless coatings into a commercially acceptable product is desirable.

SUMMARY OF THE INVENTION

The invention provides a writing system comprising a plurality of carbonless, repositionable self-adhesive note paper which is stacked and a method of manufacturing the writing system, such as stacked note paper. The invention provides a method for making a predetermined number of copies from a single written message. The invention is based upon the discovery that image transfer onto sheets of carbonless copy paper in a pad beyond the preselected number can be prevented by controlling the microparticle size of the carbonless copying component on the uppermost sheet and the paper thickness or basis weight of the bottom sheet that make up the preselected number of sheets. These two elements substantially prevent image transfer onto the underlying sheets in the pad.

In one embodiment, a carbonless copying system comprises a plurality of two-part units where each unit comprises: a) a first sheet of paper having front and back surfaces, said back surface comprising a carbonless copying component having an average microcapsule size of less than 4.5 $\mu$m and a removable and repositionable pressure sensitive adhesive; and b) a second sheet of paper having front and back surfaces, said front surface comprising a layer of a carbonless image transfer material for cooperation with said carbonless copying component on said first sheet to enable an image to be transferred to said second sheet upon application of localized pressure to said first sheet, wherein the second sheet of paper is of a sufficient basis weight to significantly prevent transfer of an image to an adjoining unit. The sheets of paper are temporarily adhered in a stacked configuration by said pressure sensitive adhesive. The second sheet of paper can optionally comprise a layer of removable and repositionable pressure sensitive adhesive on at least a portion of the back surface.

In another embodiment, a carbonless copying system comprises a plurality of multi-part units where each unit comprises: a) a first sheet of paper having front and back surfaces, said back surface comprising a carbonless copying component having an average microcapsule size of less than 4.5 $\mu$m and a removable and repositionable pressure sensitive adhesive; b) at least one middle sheet of paper having front and back surfaces, said front surface comprising a layer of a carbonless image transfer material for cooperation with the carbonless copying component of said first sheet, and said back surface comprising a carbonless copying component and a removable and repositionable pressure sensitive adhesive; and c) a bottom sheet of paper having front and back surfaces, said front surface comprising a carbonless image transfer material for cooperation with said carbonless copying component on the middle sheet, wherein the bottom sheet of paper is of a sufficient basis weight to significantly prevent transfer of an image to an adjoining unit upon localized pressure to said first sheet. The sheets of paper are temporarily adhered in a stacked configuration by said pressure sensitive adhesive.

The writing system can be produced by a method comprising assembling a plurality of two-part or multi-part units described above into a stacked configuration. The copying system can be a note pad, multi-part business form or the like but for clarity of discussion throughout this application, the note pad format will be discussed to illustrate the invention, but in no way does it limit the scope of the invention.

The note pads can be used to make multiple copies of a single message, of which each copy can be attached to any desired object, removed and repositioned without damaging the surface of the object. The note pad further enables an author to make a preselected number of copies of a message, which is defined as a unit, without having the message be transferred onto underlying units in the pad that are not preselected. In other words, the message will only be transferred onto each of the sheets that comprise the unit.

DETAILED DESCRIPTION OF THE INVENTION

Figure 1:
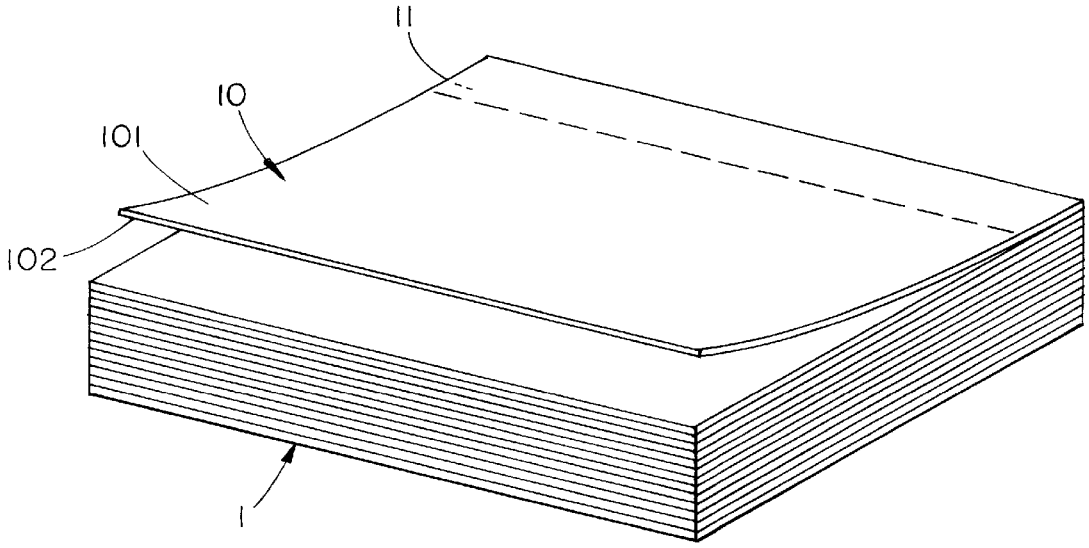
FIG. 1 is a perspective view of a stack of the carbonless, repositionable self-adhesive note paper.

The invention provides a writing system comprising a plurality of carbonless, repositionable self-adhesive note paper which is stacked and a method of manufacturing the writing system, such as stacked note paper. The invention provides a method for making a predetermined number of copies from a single written message using a carbonless copying system comprising a plurality of units, where a unit is defined herein as the predetermined number of copies. For example, the unit can comprise two or more sheets (preferably up to five sheet) of carbonless, repositionable copying paper where all sheets of paper in the unit receive the writing image but the image is not transferred onto subsequent units in the note pad stack. The invention is further described by the drawings, which in no way are intended to limit the invention to the embodiments illustrated in the drawings provided herein.

Figure 2:
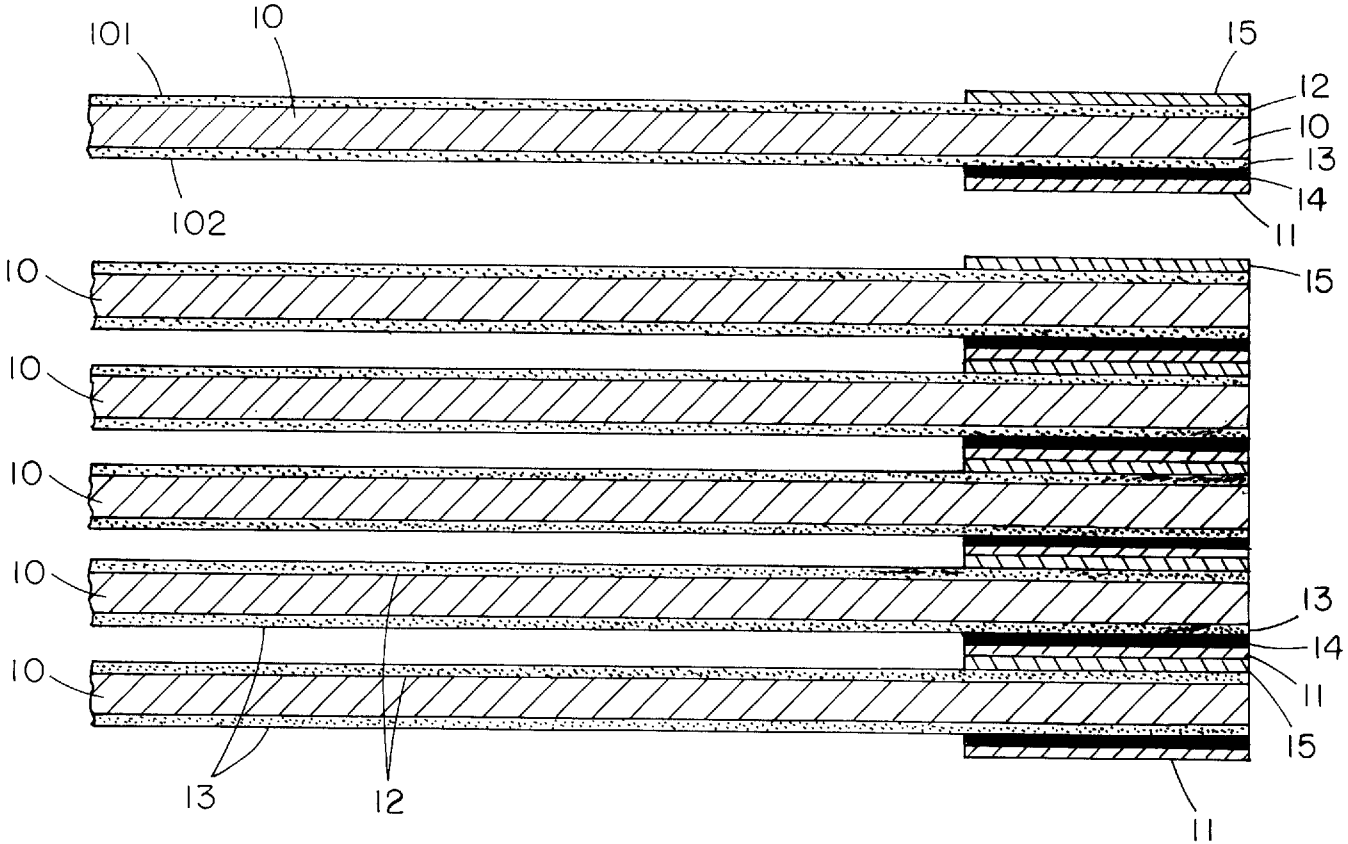
FIG. 2 is a cross-sectional view of the note paper stack shown in FIG. 1.

In one embodiment, as shown in FIG. 1, a stack of note paper 1 (herein referred to as "note pad") comprises a plurality of individual carbonless copying paper sheets 10 which are secured along one marginal edge 11 on the underside 102 of each sheet 10 with a removable, repositionable pressure sensitive adhesive (shown in FIG. 2).

FIG. 2 shows a detailed cross-sectional view of a preferred embodiment (e.g., a note pad), such as that illustrated in FIG. 1. The front surface 101 of each sheet comprises a layer of color developer 12 and the back surface 102 of each sheet comprises a layer of microencapsulated dye 13. Both the front surface 101 and the back surface 102 of each sheet 10 further comprises a layer of resin 15 and 14, respectively, coated on a portion of the sheet. A pressure sensitive adhesive 11 layer is then applied onto the resin 14. The resin and adhesive are placed on a portion of the sheet back surface 102, such as in the form of a strip at one end of the sheet which can preferably be the top or side of the note pad. The layer of resin 15 on the front surface 101 of sheet 10 is however optional and preferably applied only to the region that will come into contact with the pressure sensitive adhesive 11 on the back surface 102 of the adjacent sheet of paper in a note pad configuration.

Figure 3:
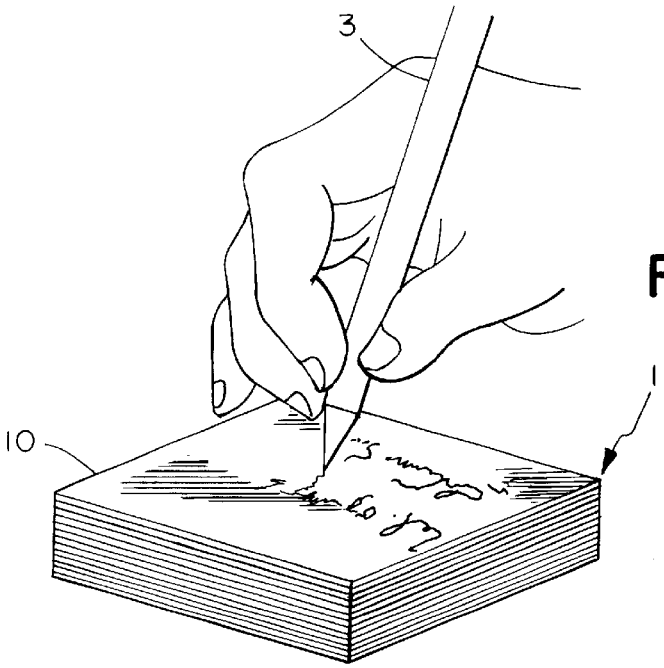
FIG. 3 illustrates the use of a note pad comprising a plurality of three-part units to generate three copies.
Figure 4:
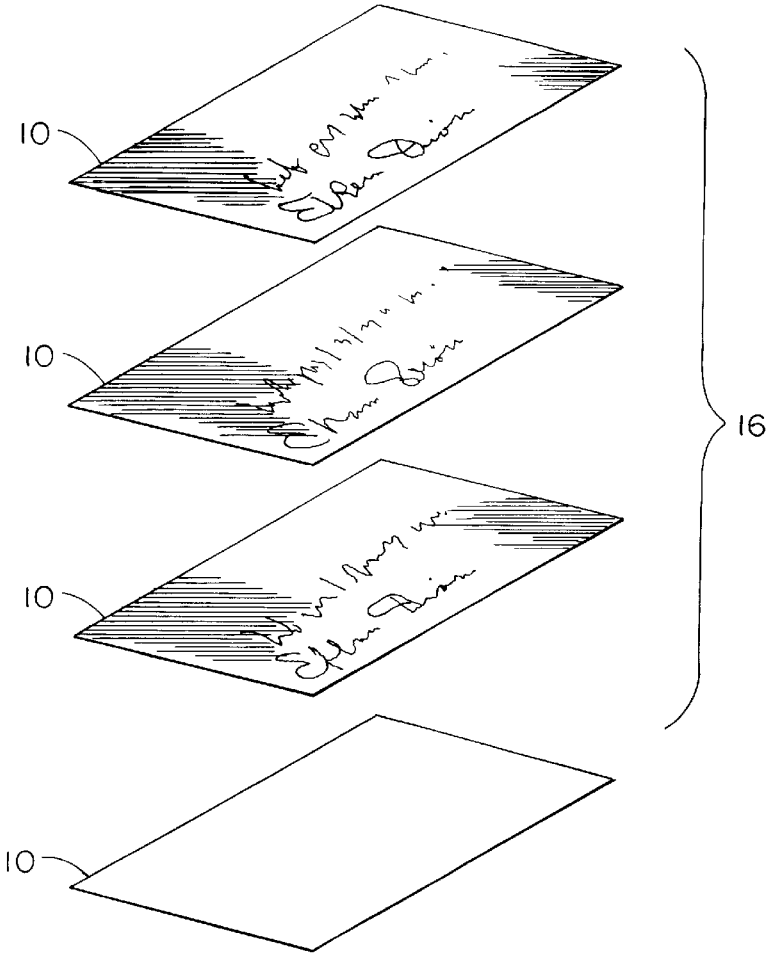
FIG. 4 illustrates the product generated as shown in FIG. 3 whereby three copies are made. The fourth sheet which is blank represents the first sheet of the adjacent unit.

FIG. 3 illustrates a single writing event on the note pad 1. The note pad comprises a plurality of units where each unit 16 comprises three sheets of paper. The single writing event on the uppermost sheet 10 in the note pad results in an original and two copies (FIG. 4). The fourth sheet of paper (i.e., the first sheet in the subsequent unit in the pad) in the note pad does not take up the image transferred onto the first unit.

Each sheet of copying paper can be repositioned onto another surface such as, but not limited to, paper, fabric, wood, plastics, plaster, metal, or other surface material. Each sheet of paper that comprises the note pad is preferably obtained from a stock of pre-made conventional carbonless copying paper and then further processed by coating at least a portion of the back surface of the paper with a removable and repositionable pressure sensitive adhesive. In one embodiment, a resin can be coated onto the carbonless copying component prior to adhesive application and can optionally be coated onto the front surface of the paper, wherein the resin coated portion corresponds to the position of the adhesive strip on the back surface of the adjacent sheet when it is stacked into a note pad. The purpose of the resin is to mask the carbonless copying components of the paper from the adhesive. Such masking will avoid contamination of the adhesive which could reduce adhesive performance under storage conditions, for example. This concept has been described in U.S. Patent application Ser. No. 08/694,639, filed Aug. 7, 1996, the entire teachings of which are incorporated herein by reference. Once the individual sheets are made, they are cut and piled into pads in any amount depending upon intended use. Techniques for assembly into note pads, business forms or other similar products are well known in the industry. The terms "repositionable" and "repositioned" are intended herein to mean a sheet of paper which has an adhesive thereon which can be temporarily attached to one surface, removed from the surface without damaging the integrity of the surface from which it is removed and then adhered to another surface of similar or different material.

Any adhesive which meets the repositionable definition provided herein can be used. Preferred examples of "repositionable" adhesives that can be used in this invention have been described in U.S. Pat. Nos. 5,109,083 and 5,194,329, the teachings of which are incorporated by reference herein in their entirety. These patents describe the preparation and use of inherent tacky, elastomeric, solvent-insoluble, solvent-dispersible polymeric microparticles by aqueous emulsion polymerization. A preferred type of adhesive is an acrylate repositionable adhesive. The size of the adhesive area will be dictated by the size of the sheet of note paper but in any event the adhesive area should be large enough to adequately adhere the paper to a surface. The configuration of adhesive on the sheets can be varied according to design preference. However, the preferred location to the adhesive will be along one marginal edge of the paper as illustrated in FIG. 2.

Conventional carbonless copying paper typically comprises a layer of microcapsules (also referred to herein as the carbonless copying component) which contain an encapsulated solvent, and soluble dye (e.g., Leuco Dye in solvent) on the back surface 102 of the note paper. Any carbonless paper and its technology can be used. This surface is defined as "coated back" or "CB" paper. A layer of color developing material (also referred to herein as carbonless image transfer material), such as phenolic resin, active clay or salicylic type resins, is applied onto the front surface 101 of a continuous sheet of note paper such that it is in contact with the "CB" paper. This coated surface is defined as "coated front" or "CF". A composite sheet of paper containing both "CF" and "CB" is referred to as a "coated front and back" or "CFB". Typical carbonless copying systems include a combination of adjacent cooperating CB and CF layers on adjacent sheets. For example, the bottom surface of the top sheet is typically coated with carbonless microcapsules (the CB coating or layer) which burst upon the application of localized pressure, to transfer, an image onto a resinous or clay coating (the CF coating or layer) provided on the top surface of a lower adjacent sheet.

An important factor in preventing image transfer onto subsequent units in the note pad is to regulate the microcapsule size of the carbonless copying component on the back surface of the first sheet in each unit. The microcapsules should be sufficiently small such that writing pressure will rupture the microcapsules in the first unit but will not cause the microcapsules to rupture in subsequent underlying units. Preferably the microcapsule size will be less than 4.5 $\mu$m, with from about 3.0 $\mu$m to about 4.0 $\mu$m being most preferred.

The second factor, which is important in controlling undesired image transfer onto the adjacent unit, is manipulating paper thickness or weight of the last sheet in each unit. The thickness or weight of the last sheet will be that which reduces the writing pressure on the first sheet of the adjacent unit to a level which is insufficient to rupture the small microcapsules that comprise the carbonless copying component thereon. The preferred basis weight of the last sheet in a unit is at least about 60 g/m$^2$, with from about 80 g/m$^2$ to about 150 g/m$^2$ being most preferred. The basis weight of the other sheets in the unit can be of standard basis weight, for example from about 40 to about 50 g/m$^2$.

Figure 5:
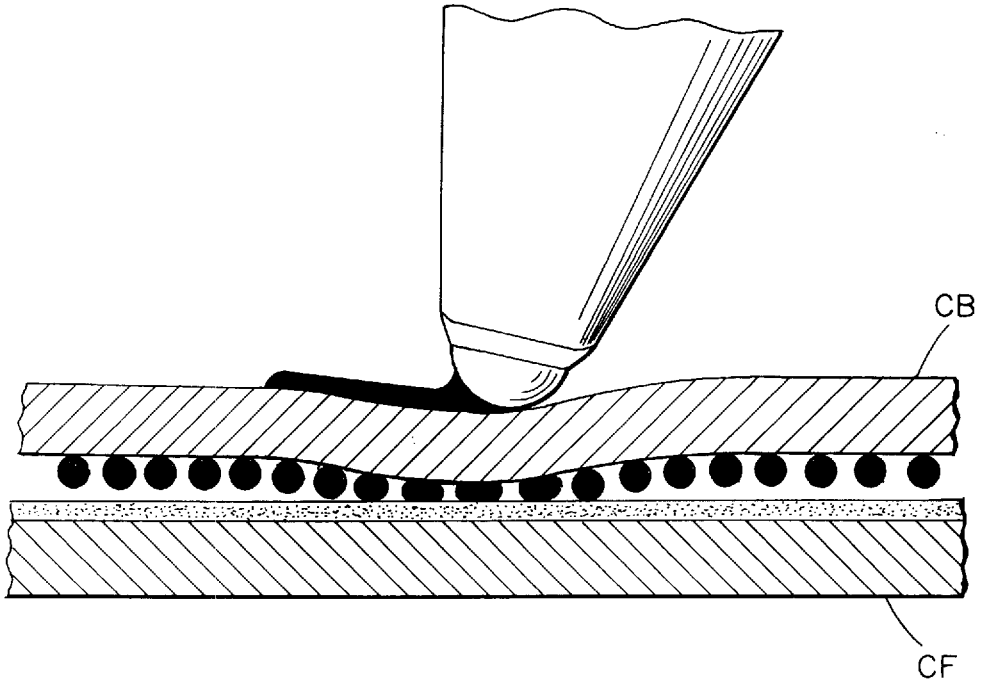
FIG. 5 is an expanded view of an illustration of two sheets of note paper of this invention when writing pressure is applied to the surface of the note paper.

As shown in FIG. 5, by writing on the top of the first sheet, the pressure of the writing pen ruptures the microcapsules on the "CB" paper, thus causing the dye to squeeze out. The dye reacts with the "CF" paper's color developer. The chemical reaction results in an image of the written message on all the sheets in the unit. In one embodiment, when a plurality of note paper is stacked into a note pad configuration, the first sheet in the stack is a CB paper. The bottom sheet is a CF paper and the plurality of note paper there between will be CFB paper. Although it is not essential that the first and last sheet of the note pad be CB and CF paper, respectively, this configuration may be preferred for the manufacture of business forms.

Figure 6:
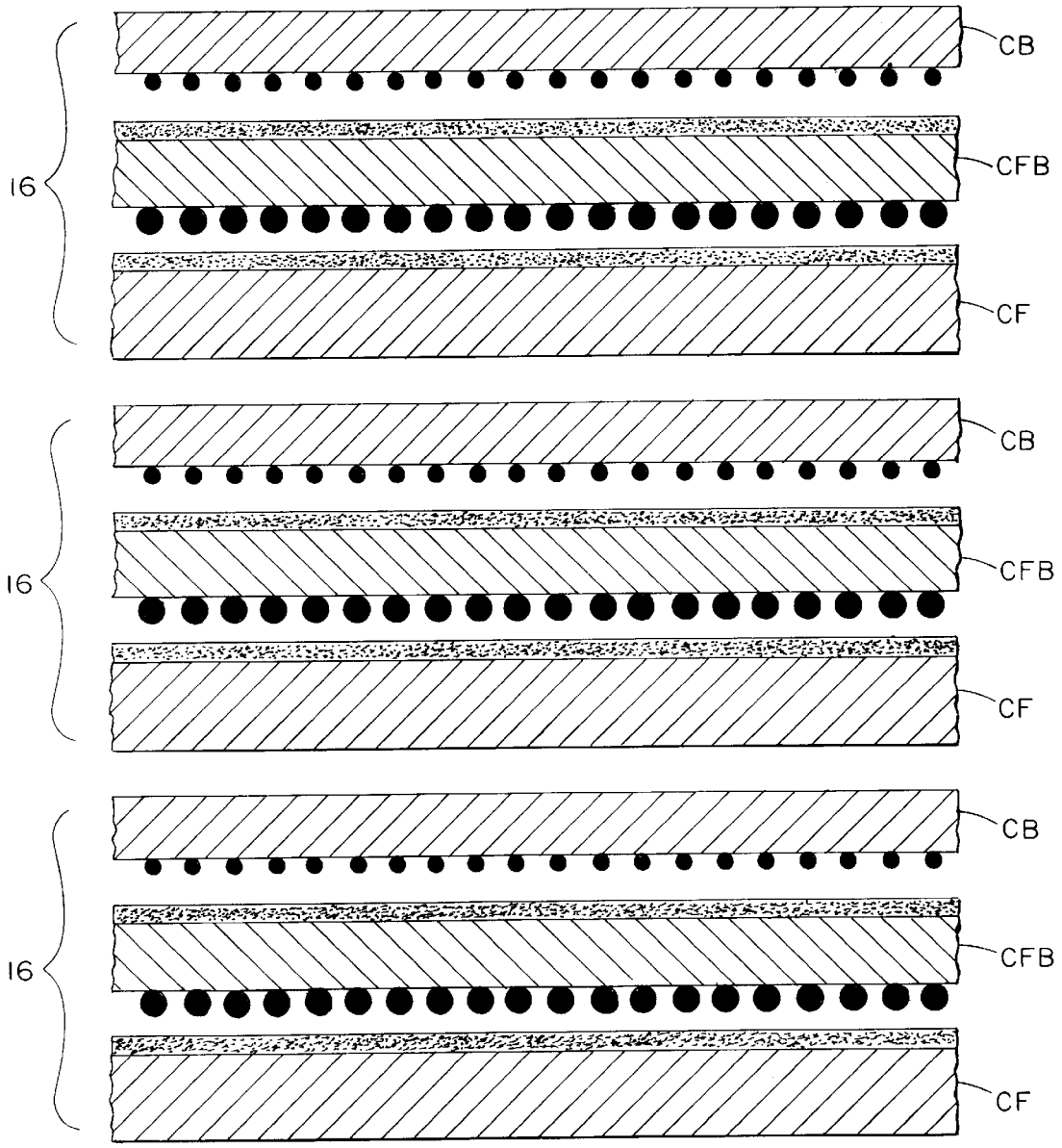
FIG. 6 is an expanded view of three units each comprising three sheets of carbonless, repositionable self-adhesive note paper.

FIG. 6 demonstrates a preferred configuration of a plurality of three-part units 16. Three units are shown for illustration purposes but any number of units can be stacked. Each unit 16 comprises a first sheet of CB carbonless paper having small microcapsules comprising the carbonless copying component on the back surface thereof; a middle sheet which is CFB paper; and a bottom sheet of CB paper that is thicker and greater in weight than the first and middle sheet. Additional sheets of CFB paper can be placed between the CB and CF sheets if more copies beyond that provided in the pad is needed.

In another embodiment, the note pad will comprise a plurality of stacked units which all sheets comprising each unit are CFB paper. Image transfer from one unit to the underlying unit is prevented using the two factors described herein, namely controlling microcapsule size of the carbonless copying component on the back surface of the first sheet in the unit and utilizing paper which is of a sufficient weight for the last sheet in each unit, as discussed above. See FIG. 2 for a schematic representation of a pile of adjacent cooperating CFB sheets of paper.

A note pad of stacked carbonless, repositionable self-adhesive paper can be made, for example, by coating a roll of CFB paper on the front surface (i.e., the color developer side) with a thin layer of polyvinylalcohol (from about 5 $\mu$m to about 50 $\mu$m in thickness). The paper roll is then coated on the back surface (the microencapsulated side) again with polyvinylalcohol, followed by a coating of repositionable adhesive (from about 5 $\mu$m to about 400 $\mu$m) on the same side. The roll of coated CFB paper is then cut and piled into jumbo paper pads. The jumbo pads can be further cut into smaller note pads. A specific example of the manufacture of the present invention is described below.

The note pad can be used to make multiple copies of a single message where the number of copies is predetermined by the unit configuration of the stack. For example, a unit can comprise a stack of two to five carbonless, repositionable sheets of note paper, where it is desired that the author make two to five copies of the message. This concept is useful for pre-made forms where repositionable copies of a desired number are needed. When writing pressure is applied to create the message the copies, only those sheets of carbonless, repositionable paper in the uppermost unit to which pressure is applied will receive the written image.

Equivalents

Those skilled in the art will recognize or be able to ascertain, using no more than routine experimentation, many equivalents to the specific embodiments of the invention described herein. Such equivalents are intended to be encompassed by the following claims:

We claim:

1. A removable and repositionable pressure sensitive carbonless copying system comprising a plurality of units, each unit comprising:

a) a first sheet of paper having front and back surfaces, said back surface comprising a carbonless copying component having an average microcapsule size of less than 4.5 $\mu$m and a removable and repositionable pressure sensitive adhesive; and b) a second sheet of paper having front and back surfaces, said front surface comprising a layer of a carbonless image transfer material for cooperation with said carbonless copying component on said first sheet to enable an image to be transferred to said second sheet upon application of localized pressure to said first sheet, wherein the second sheet of paper is of a sufficient basis weight to significantly prevent transfer of an image to an adjoining unit, wherein said sheets of paper are temporarily adhered in a stacked configuration by said pressure sensitive adhesive.

2. The pressure sensitive carbonless copying system of claim 1 wherein said pressure sensitive adhesive is an acrylate repositionable adhesive.

3. The pressure sensitive carbonless copying system of claim 1 wherein the microcapsule size is from about 3.0 $\mu$m to about 4.0 $\mu$m.

4. The pressure sensitive carbonless copying system of claim 1 wherein the basis weight of said second sheet of paper is at least about 60 g/m$^2$.

5. The pressure sensitive carbonless copying system of claim 4 wherein the basis weight of said second sheet of paper is from about 80 g/m$^2$ to about 150 g/m$^2$.

6. The pressure sensitive carbonless copying system of claim 1 wherein the front surface of the first sheet further comprises a layer of carbonless image transfer material.

7. The pressure sensitive carbonless copying system of claim 1 wherein the back surface of the second sheet further comprises a layer of a carbonless copying component.

8. A removable and repositionable pressure sensitive carbonless copying system comprising a plurality of units, each unit comprising:

a) a first sheet of paper having front and back surfaces, said back surface comprising a carbonless copying component having an average microcapsule size of less than 4.5 $\mu$m and a removable and repositionable pressure sensitive adhesive;

b) at least one middle sheet of paper having front and back surfaces, said front surface comprising a layer of a carbonless image transfer material for cooperation with the carbonless copying component of said first sheet, and said back surface comprising a carbonless copying component and a removable and repositionable pressure sensitive adhesive; and c) a bottom sheet of paper having front and back surfaces, said front surface comprising a layer of a carbonless image transfer material for cooperation with said carbonless copying component on the middle sheet, wherein the bottom sheet of paper is of a sufficient basis weight to significantly prevent transfer of an image to an adjoining unit upon localized pressure to said first sheet;

wherein said sheets of paper are temporarily adhered in a stacked configuration by said pressure sensitive adhesive.

9. The pressure sensitive carbonless copying system of claim 8 wherein said pressure sensitive adhesive is an acrylate repositionable adhesive.

10. The pressure sensitive carbonless copying system of claim 9 wherein there is a plurality of element (b) in a stacked configuration in which the uppermost sheet in the stack contacts element (a) and the bottom sheet contacts element (c).

11. The pressure sensitive carbonless copying system of claim 8, wherein the microcapsule size is from about 3.0 $\mu$m to about 4.0 $\mu$m.

12. The pressure sensitive carbonless copying system of claim 8 wherein the basis weight of said bottom sheet of paper is at least about 60 g/m$^2$.

13. The pressure sensitive carbonless copying system of claim 12 wherein the basis weight of said bottom sheet of paper is from about 80 $g/m^2$ to about 150 $g/m^2$.

14. The pressure sensitive carbonless copying system of claim 8 wherein the front surface of the first sheet further comprises a layer of carbonless image transfer material.

15. The pressure sensitive carbonless copying system of claim 8 wherein the back surface of the bottom sheet further comprises a layer of a carbonless copying component.

* * * * *